United States Patent [19]

Rippin

[11] 4,421,283

[45] Dec. 20, 1983

[54] STRIP RECOILING APPARATUS

[75] Inventor: John W. Rippin, Streetsville, Canada

[73] Assignee: Pro-Eco Limited, Mississauga, Canada

[21] Appl. No.: 276,675

[22] Filed: Jun. 23, 1981

[51] Int. Cl.[3] ..... B65H 19/04; B65H 75/24

[52] U.S. Cl. ..... 242/56.9; 242/63; 242/72.1; 242/78.1

[58] Field of Search ..... 242/56.2, 56.9, 72.1, 242/74.1, 74.2, 78.1, 63

[56] References Cited

U.S. PATENT DOCUMENTS

| | | | |
|---|---|---|---|
| 2,352,042 | 6/1944 | Linde | 242/74.1 X |
| 3,870,243 | 3/1975 | Briggs | 242/72.1 |
| 4,093,140 | 6/1978 | Matsunaga | 242/56.2 |
| 4,175,715 | 11/1979 | Raynor | 242/72.1 |
| 4,199,116 | 4/1980 | Matsunaga | 242/63 |
| 4,201,352 | 5/1980 | Madachy | 242/56.2 |
| 4,280,671 | 7/1981 | Miller | 242/72.1 X |

FOREIGN PATENT DOCUMENTS

| | | | |
|---|---|---|---|
| 1172920 | 6/1964 | Fed. Rep. of Germany | 242/72.1 |

*Primary Examiner*—John M. Jillions

*Attorney, Agent, or Firm*—Christel, Bean & Linihan

[57] ABSTRACT

A strip recoiling drum including a gripper slot and a movable gripper bar for gripping the end of a strip to be recoiled and a pair of axially pivotable drum walls to vary the drum circumference. The gripper bar and drum walls are movable by means of longitudinally movable internal wedge members which are simultaneously actuated by an hydraulic piston and cylinder arrangement to close the gripper slot and expand the drum circumference. The gripper bar includes wedge elements which engage cooperating wedge elements on the gripper wedge member and a radially movable wedge to move the drum walls is cooperatively engaged with an axially movable drum wedge actuator member. Initial movement of the wedge members grasps the leading edge of the strip in the gripper slot and simultaneously moves the drum walls outwardly to their maximum circumference positions. Hydraulically operated external wedges are adapted to move the internal wedge members in an opposite direction, thereby releasing the grip of the gripper bar on the leading edge of the strip being recoiled and simultaneously causing the drum walls to be moved inwardly to reduce the drum circumference. The movement of the wedge members in either direction can be accomplished while the drum is rotating.

8 Claims, 15 Drawing Figures

Fig. 1.
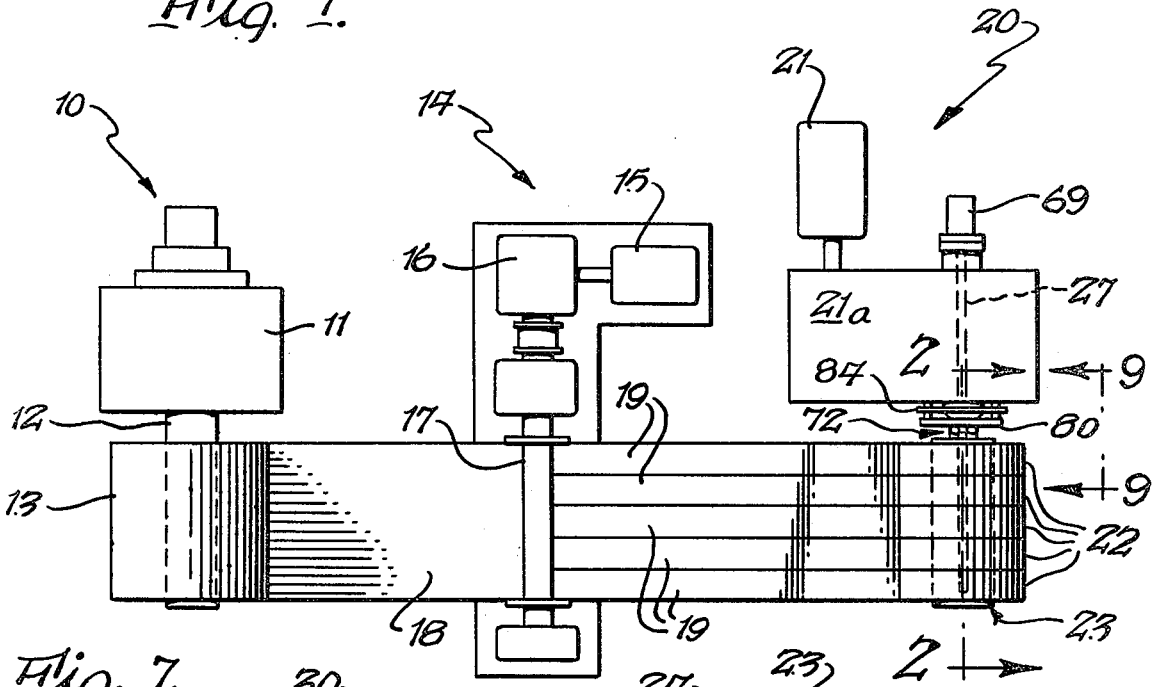
Fig. 7.
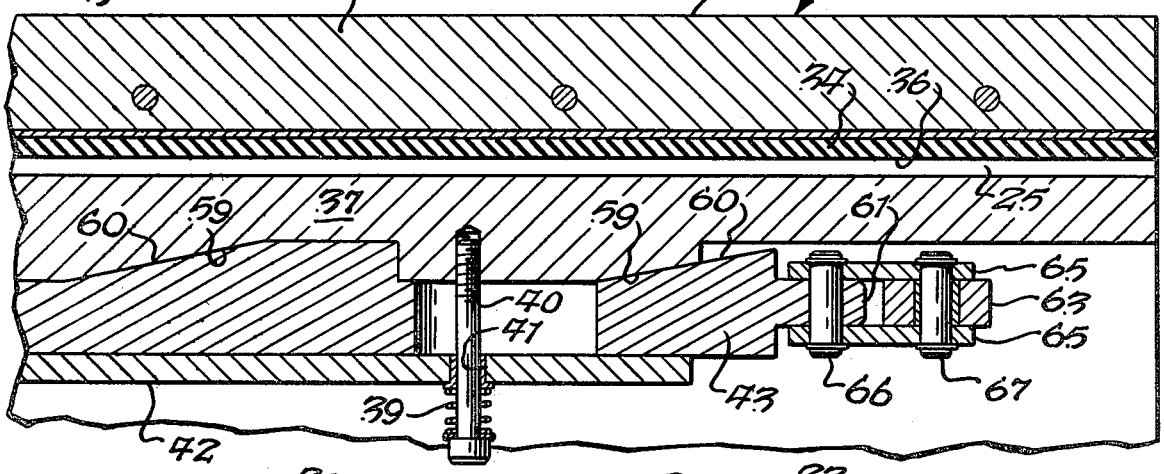
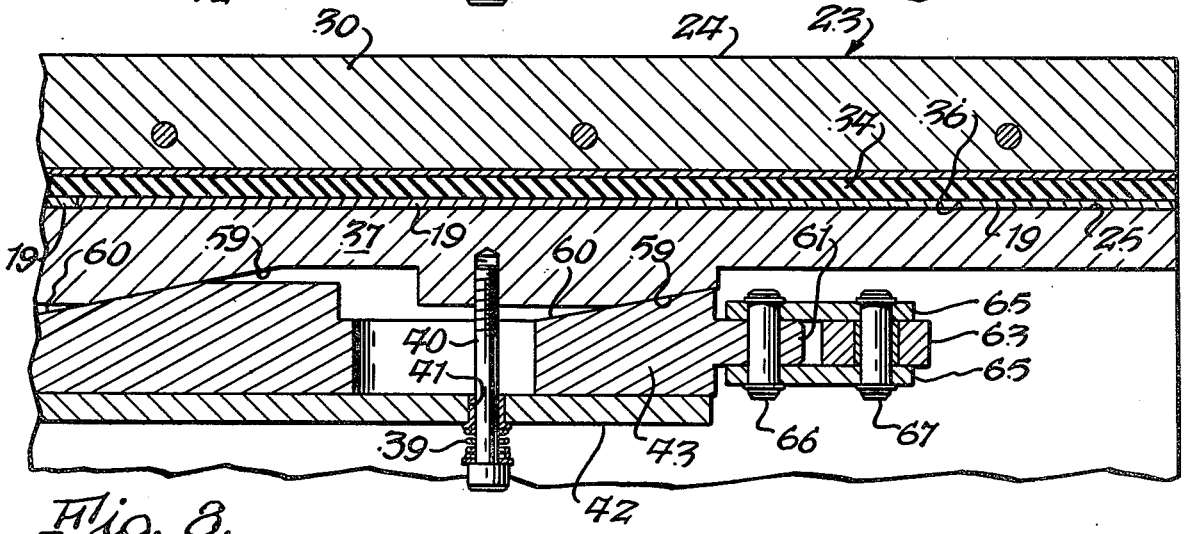
Fig. 8.

Fig. 10.
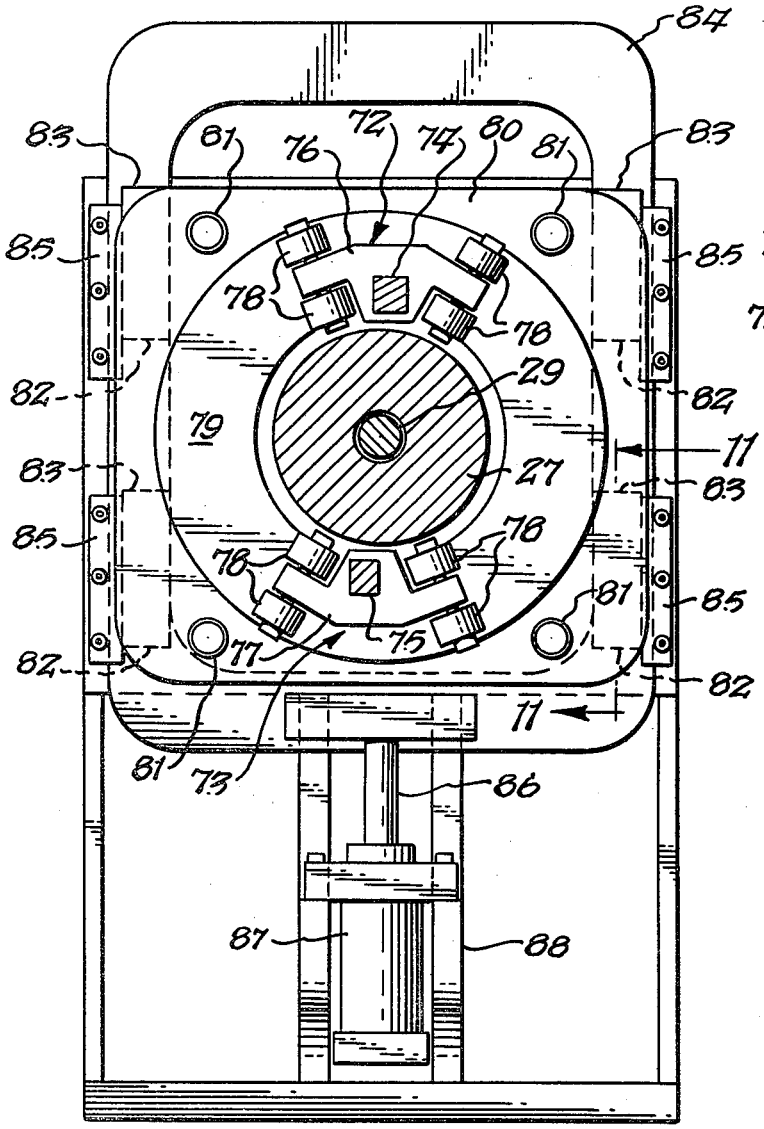
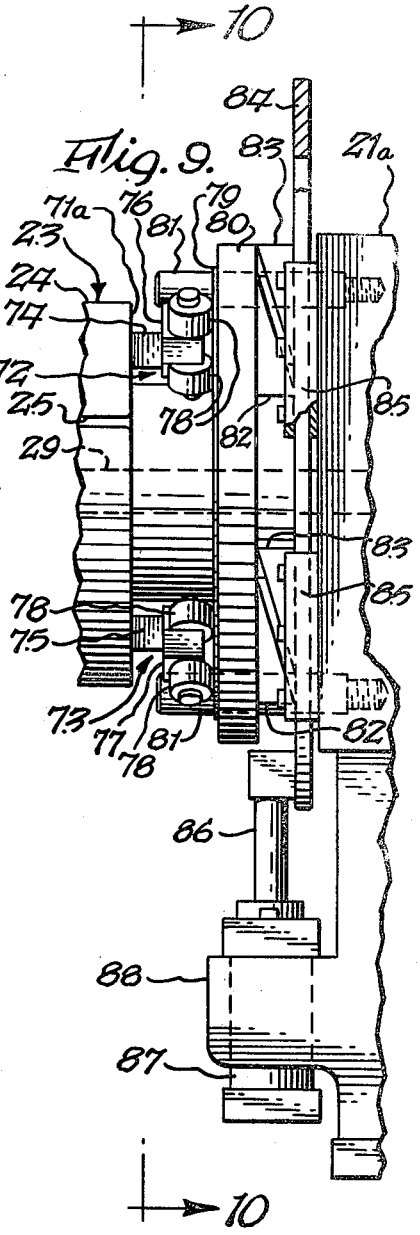
Fig. 9.
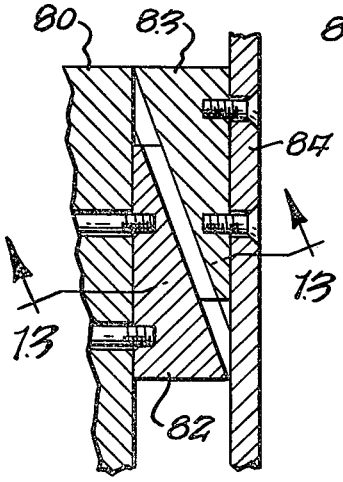
Fig. 11.
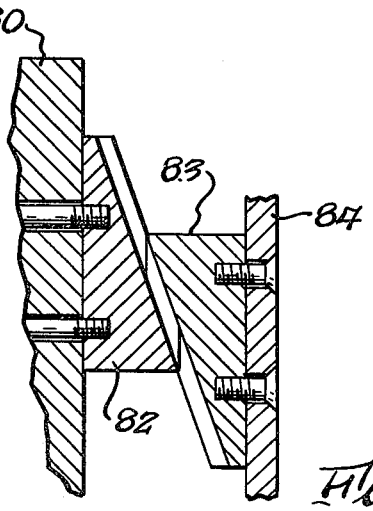
Fig. 12.
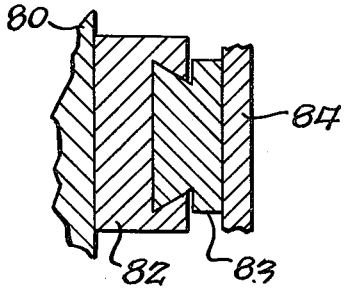
Fig. 13.

STRIP RECOILING APPARATUS

BACKGROUND OF THE INVENTION

This invention relates to apparatus for winding strips of material into coils, and more particularly to a recoiling drum incorporating gripping means for gripping the end of the strip to be coiled, and also means to selectively vary the circumference of the drum while the drum is rotating.

In many instances when a sheet of metal supplied in roll form is desired to be cut into a plurality of narrower strips which are to be rewound in coil form, the recoiling operation frequently results in problems because the original sheet is not of uniform thickness across its width. Oftentimes the sheet is thicker at its center than it is at its edges. As a consequence when such a sheet is slit into narrower strips and tension is applied in order to provide tightly wound coils, those strips at the center of the sheet are wound more tightly on the recoiler or take-up roll and also more quickly because the additional thickness results in a larger diameter coil, the tangential velocity of which is greater than that of the outer coils. Thus those strips toward the edges of the sheet are wound with lower tension, causing looser coils and also causing sagging of the outermost strips between the slitter and the recoiling drum, which results in the strips dragging on and accumulating on the factory floor between the slitter and recoiler.

Several methods have been devised to overcome the above-mentioned problems, one of which involves providing a so-called looping pit to permit the outermost strips to extend into a substantially rectangular depression positioned between the slitter and the recoiler and below the floor level. Oftentimes pits of this type have a depth of perhaps ten (10) feet or so. An example of such an arrangement utilizing a looping pit to receive slack strips is shown in U.S. Pat. No. 3,672,595.

Another method suggested to overcome the problems mentioned above involves positioning spacers in the outermost coils as they are being wound, in order to increase their diameter and thereby to increase the take-up velocity, which, in turn, reduces the sag in the outermost strips. For example, in U.S. Pat. No. 4,093,141 there is shown a device for intermittently shooting fibreboard spacers between a slit web and the coil around which it is being wound.

Still another way in which coil looseness and strip sagging problems have been addressed is to permit circumferential slippage of certain of the coils as they are being wound upon the recoiling drum. In that type of arrangement the innermost coils would be permitted to slip with respect to the drum so that the take-up velocity of the innermost strips is reduced to approximately that of the outermost strips, thereby permitting the recoiler to be driven at such a speed that sagging and loose coils are avoided. Such a method is disclosed in U.S. Pat. No. 4,093,140, together with one form of apparatus intended to permit practicing that method. Another form of apparatus for practicing that method is shown in U.S. Pat. No. 4,199,116. Another patent which shows a similar method but which also includes the interposition of means to connect a portion of each strip to a previously wound portion of the same strip is U.S. Pat. No. 4,201,352.

In the apparatus described in connection with the slip-coil methods of tension equalization disclosed in the above-identified patents, the recoiler drum is collapsible to a certain extent, to permit the slippage of the innermost coils to take place, and the means by which the leading edges of the respective strips are initially gripped is releasable. However, the structural arrangement disclosed in U.S. Pat. No. 4,199,116 is not capable of re-expanding a collapsed drum while the drum is rotating, a feature which is highly desirable for greater flexibility of operation. Although the apparatus disclosed in U.S. Pat. No. 4,201,352 may be capable of such operation, it utilizes a flexible hose member which can be expanded or contracted by the addition or removal of hydraulic fluid. Such an arrangement is subject to leaks of hydraulic fluid and possible hose breakage.

It is an object of the present invention to overcome the deficiencies of the prior art devices and to provide an improved recoiling drum which includes positive means to grip the strips of material being wound on the drum, and also to provide mechanical means for positively releasing the gripper engagement while simultaneously reducing the effective drum diameter and subsequently permitting reclosing of the gripper device and also re-expansion of the drum, as desired, with any number of subsequent opening and closing operations as may be necessary during a particular recoiling operation.

SUMMARY OF THE INVENTION

Briefly stated, in accordance with one aspect of the present invention, there is provided an improved recoiler drum structure which incorporates gripping means in the form of a gripper slot to receive the material being wound upon the drum. The gripper slot is adapted to be selectively opened or closed, as desired, by moving a gripper by means of a longitudinally movable wedge means. Additionally, the drum itself includes two hinged circumferential portions which are permitted to move in such a fashion as to increase or decrease the circumference of the drum. Means are provided for actuating the gripper to engage the leading edge of the material to be recoiled and simultaneously to expand the drum to its maximum diameter. The drum expansion is accomplished by a similar longitudinally movable wedge means to force the movable segments of the drum in an outward direction. Also provided is a means for collapsing the drum diameter and for simultaneously moving the gripper out of gripping engagement with the material to be recoiled. Both the gripping and drum expansion, and also the gripper release and drum contraction operations are capable of being performed while the drum is rotating.

BRIEF DESCRIPTION OF THE DRAWINGS

FIG. 1 is a plan view of a sheet slitting line showing the several elements thereof in their operative relationship and including a collapsible recoiling drum according to the present invention which incorporates strip gripping means.

FIG. 7 is a fragmentary cross-sectional view of the strip gripping means taken along the line 7—7 of FIG. 3 and showing the gripping means in its open condition.

FIG. 8 is a fragmentary cross-sectional view of the strip gripping means, similar to that shown in FIG. 7, but showing the gripping means in its closed condition.

FIG. 9 is a fragmentary side view of the drive end of the recoiling drum taken along the line 9—9 of FIG. 1 and showing the wedge means for collapsing the drum and releasing the gripper.

FIG. 10 is an end view of the wedge means for collapsing the drum and releasing the gripper taken along the line 10—10 of FIG. 9.

FIG. 11 is a frgmentary cross-sectional view showing the wedge means for collapsing the drum and releasing the gripper taken along the line 11—11 of FIG. 10 with the wedge means in the position wherein the drum is expanded and the gripper is closed.

FIG. 12 is a fragmentary cross-sectional view similar to that of FIG. 11, except that the wedge means is in the position wherein the drum is collapsed and the gripper is opened.

FIG. 13 is a fragmentary cross-sectional view of the wedges taken along the line 13—13 of FIG. 11.

DESCRIPTION OF THE PREFERRED EMBODIMENTS

Figures 2, 4, 5, 5A, 5B, 6:
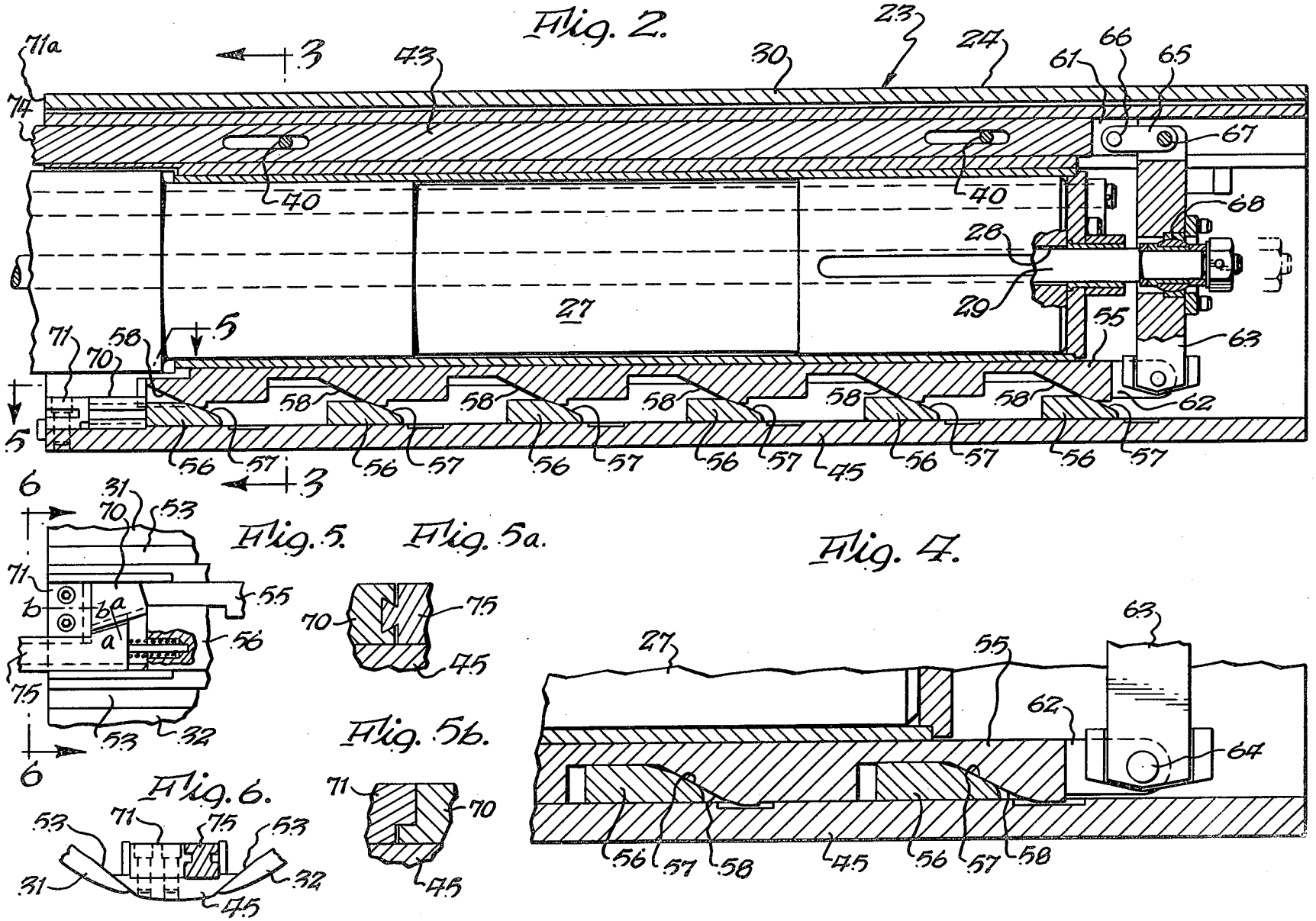
FIG. 2 is a fragmentary, longitudinal cross section of the recoiling drum taken along the line 2—2 of FIG. 1 and showing the drum in its expanded condition.
FIG. 4 is a fragmentary cross-sectional view of the drum expansion and collapsing means with the drum in collapsed condition.
FIG. 5 is a fragmentary plan view of an end of the drum expansion and collapsing means taken along the line 5—5 of FIG. 2.
FIG. 5*a* is a fragmentary cross-sectional view taken along the line a—a of FIG. 5.
FIG. 5*b* is a fragmentary cross-sectional view taken along the line b—b of FIG. 5.
FIG. 6 is a fragmentary end view, partially in section, of the end of the drum expansion and collapsing means shown in FIG. 5 and taken along the line 6—6 of FIG. 5.

Referring now to the drawings, and particularly to FIG. 1 thereof, there is shown a conventional slitting line which incorporates the recoiling apparatus of the present invention. As shown, the slitting line includes an uncoiler 10 which is driven by a motor and gearbox arrangement 11. The uncoiler includes a drum 12 upon which is mounted a coil 13 of sheet material which is to be longitudinally slit into narrow strips and then recoiled. Uncoiler 10 can include means for braking the device to apply tension to the sheet material as it is being uncoiled. The uncoiled sheet passes through a slitter 14, which can be of any conventional design as is well-known to those skilled in the art, and which includes a drive motor 15 and a gearbox 16. Slitter 14 includes a series of spaced cutters (not shown), which are mounted on a mandrel 17 and which cut the uncoiling sheet 18 into a plurality of narrower widths of material, which will hereinafter be referred to as strips 19. Individual strips 19 then pass to a recoiler 20, the function of which is to rewind each of strips 19 into a coil 22 in order to provide a series of coils 22 or narrower widths as compared with that of the originally-wound coil 13. Recoiler 20 includes a drive motor 21 and also a gearbox 21*a* to control the rewinding speed. The apparatus just described in general terms is conventional and is well-known to those skilled in the art.

Figure 3:
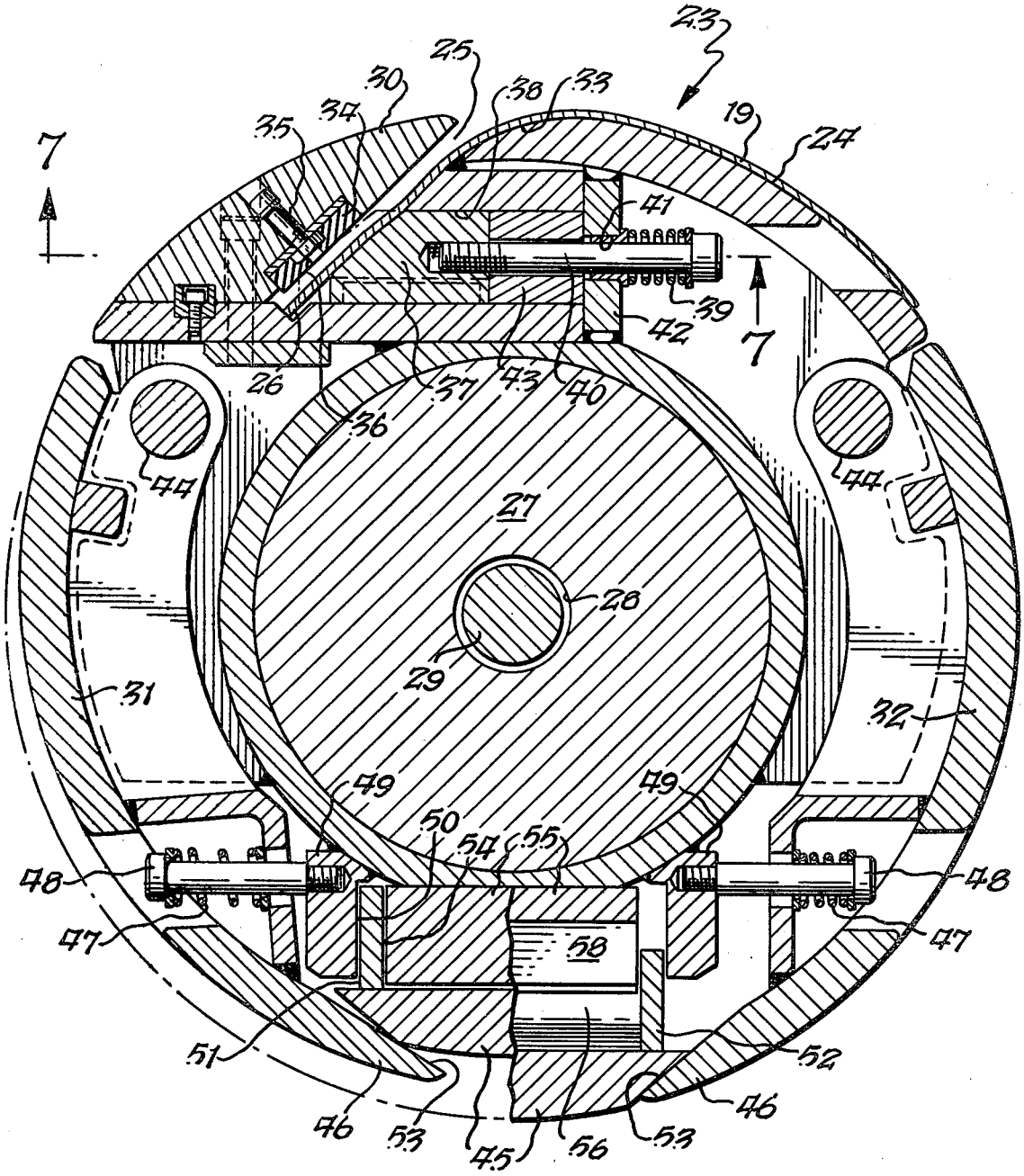
FIG. 3 is a transverse cross section of the recoiling drum taken along the line 3—3 of FIG. 2 and showing the drum in collapsed condition on the left half and in expanded condition on the right half thereof.

Referring now to FIG. 2 and 3, there are shown longitudinal and transverse cross-sectional views, respectively, of an improved recoiler drum 23 according to the present invention. Drum 23 provides an outer surface 24 about which strips 19 of material are wound, and includes an axially positioned slot 25 into which the leading edge 26 of strip 19 is inserted upon commencement of the recoiling operation. As it is shown in FIG. 3, drum 23 is intended to be rotated in a counter-clockwise direction to cause strip 19 to wound around the periphery of drum 23 and subsequently upon itself to form a continuous coil. Drum 23 includes an annular inner shaft 27 having a central bore 28 which slidably receives a concentrically positioned and longitudinally movable rod 29, the function of which will hereinafter be explained.

Concentrically positioned with inner shaft 27 is outer drum surface 24, which includes a stationary portion 30 and a pair of inwardly movable, longitudinally segmented portions 31, 32 which serve to define the effective drum diameter. Slot 25 is provided in stationary portion 30 of drum 23 and is adapted to receive one or more strips 19 to be wound upon outer surface 24 and into coils. Slot 25 is inclined with respect to outer surface 24 and includes a rounded entry portion 33 over which a portion of strip 19 wraps. Positioned within slot 25 is a longitudinal back-up member 34 which is secured to stationary portion 30 by means of a series of bolts 35. Back-up member 34 includes a gripping surface 36 to facilitate securely holding leading edge 26 and can be provided in the form of a serrated surface for positively gripping the material by means of a plurality of spaced projections which extend onto and, on occasion, into the surface of the material to be wound. Alternatively, back-up member 34 can be provided with a non-surface-marring material to grip leading edge 26, such as, for example, polyurethane.

Positioned in slot 25 opposite back-up member 34 is a movable gripper bar 37 which is slidably positioned in a longitudinal slot 38 for movement toward and away from back-up member 34. Gripper bar 37 is spring-urged away from back-up member 34 and into the open slot position, by means of a series of compression springs 39, each of which is positioned to bear against the underside of the head of a bolt 40, one end of which is secured to gripper bar 37 and the other end of which extends through an opening 41 in a support member 42 which extends between outer surface 24 and inner shaft 27. As shown in FIG. 3 only one of such bolt and spring combinations is shown, although more than one if provided in a typical drum construction, as is illustrated more clearly in FIG. 2. Interposed between support member 42 and gripper bar 37 and positioned in slot 38 is a longitudinally movable wedge member 43 the structure and function of which will hereinafter be explained.

As also shown in FIG. 3, drum 23 includes a pair of longitudinal segments 31,32 which are inwardly movable to vary the drum circumference. Each of segments 31,32 is less than a semicircle in cross section and each is pivotally mounted to non-movable portion 30 of drum 23 in such a way that its outer surface is caused to move toward and away from the central axis of drum 23. Since each of segments 31,32 is similarly constructed and differs only in that one is the mirror image of the other, the ensuing description of segment 31 and its associated parts and arrangement relative to the other parts of drum 23 is to be construed to be applicable to segment 32 as well.

Segment 31 is a segment of a circle having as its radius the maximum diameter of drum 23, and extends longitudinally along the axis of the drum. Additionally, segment 31 is pivotally connected to stationary portion 30 at pivot 44 so that segment 31 can swing toward and away from the axis of the drum to thereby vary the circumference thereof. At the point adjacent pivot 44 there is but a small gap between non-movable portion 30 of drum 23 and segment 31. The arc length of segment 31 is such that it encompasses less than 180° of arc.

A radially movable wedge member 45 is positioned adjacent the inwardly movable edge 46 of segment 31 in order to selectively force segment 31 outwardly or, alternatively, to permit it to move inwardly, thereby effectively varying the circumference of the drum. Wedge 45 includes a pair of spaced, axially positioned wedge guide members 51, 52, which extend inwardly of the drum. Segment 31 is spring-urged into the minimum drum circumference position by means of a series of spaced, logitudinally positioned springs 47, one end of which bear against a portion of segment 31 at a point spaced from pivot 44 and the other end of which bears against a bolt 48 threadedly secured to a support member 49 attached to inner shaft 27. Support members 49 adjacent each segment define an axial slot 50 for receiving guide members 51, 52 and permit wedge 45 to move radially adjacent the inner surface 53 of segment 31.

Positioned for axial movement within an internal, axial slot 54 defined by the inner surface of guide members 51, 52 is a drum wedge actuator 55 to force drum expansion wedge 45 outwardly from the position shown in the left half of FIG. 3 to the position shown in the right half thereof, thereby separating the segments and providing an increased drum circumference.

As best seen in FIG. 2, drum expansion wedge 45 includes a series of equidistant, axially spaced wedge members 56, each of which includes a similarly oriented, inclined wedge surface 57. In sliding contact with wedge surfaces 57 are a series of similarly spaced and similarly inclined wedge surfaces 58 carried by drum wedge actuator 55. As was mentioned earlier, drum wedge 45 is radially slidably carried in slot 50 defined by support members 49 (see FIG. 3). In the position shown in FIG. 2, drum wedge actuator 55, upon which are positioned wedge surfaces 58 which are in contact with inclined wedge surfaces 57 on drum expansion wedge 45, is in its left-most position, thereby causing drum expansion wedge 45 to be in its outermost radial position and, consequently, drum 23 is at its greatest circumference. As shown in FIG. 4, drum wedge actuator 55 is in its right-most position, with the wedging surfaces 58 of drum wedge actuator 55 and wedging surfaces 57 of drum expansion wedge 45 in substantially complete contact, and wherein drum expansion wedge 45 is in its innermost radial position with respect to the axis of the drum, thereby causing drum 23 to assume its smallest circumference.

As was pointed out earlier, the gripper wedge and the drum wedge actuator are structurally similar, and the former is shown more clearly in FIG. 7 and 8. As there shown, gripper bar 37 includes a series of spaced wedge surfaces 59 which extend longitudinally in a fashion similar to wedge surfaces 57 provided on drum expanding wedge 45. Cooperatively engaged with gripper bar wedge surfaces 59 are a series of similarly inclined wedge surfaces 60 carried by gripper wedge 43, which is adapted to be axially moved from its right-most position shown in FIG. 7, wherein wedge surfaces 59, 60 are in substantial contact and gripper bar 37 is spaced from back-up member 34 to the position shown in FIG. 8, wherein gripper wedge 43 is in its left-most position, and has caused gripper bar 37 to move toward back-up member 34 to provide the gripping force necessary to securely hold the leading edge of the strip of material to be rewound.

As shown in FIG. 2, gripper wedge 43 and the drum actuator wedge 55 have their outer ends, 61, 62, respectively, connected to a toggle arm 63. As shown, one end of toggle arm 63 is pivotally connected to outer end 62 of drum wedge actuator 55 by means of a pin 64, while end 61 of gripper wedge 43 is pivotally connected to the opposite end of toggle arm 63 by means of a pivot link 65 and associated pivot pins 66, 67. Toggle arm 63 is adapted to be moved axially of drum 23 by means of axial rod 29, which is rotatably connected to toggle arm 63. by means of a bearing 68 which is adapted to permit relative rotation between rod 29 and toggle arm 63 while simultaneously transferring axial motion thereto. Rod 29 extends axially through the center of drum 23 to the inner end thereof and, as shown generally in FIG. 1, is connected to a hydraulically operated piston and cylinder arrangement 69.

As will be apparent, the axial movement of which gripper wedge 43 is capable is limited by the size of slot 25. If a strip of material to be recoiled is present in slot 25, the maximum travel is reduced by the thickness of the material. Thus, the extent of axial travel of gripper wedge 43 is limited in a positive fashion.

The limitation of the axial movement of which drum wedge actuator 55 is capable is provided by a stop block 70 at the innermost end of drum 23. As shown in FIG. 5, stop block 70 limits the extent of axial movement of drum actuator wedge 55 at the outermost extent of its travel by coming into contact with a corresponding stop block 71 carried by drum expansion wedge 45. The contact position when stop blocks 70,71 are in contact is shown in FIG. **5*b* and the contact arrangement between stop block 70, drum actuator wedge 55 and drum expansion wedge 45 is shown in FIG. 5*a*. The relative positions of the parts are also illustrated in FIG. 6, which shows drum expansion wedge 45 to be in its outermost position. The end structure shown in FIG. 5 and 6 provides resistance to the longitudinal movement of the drum actuator wedge 55 to thereby maintain drum segments 31, 32** in the desired positions.

Referring now to FIG. 9, each of gripper wedge 43 and drum wedge actuator 55 extends beyond the inner end 71 of drum 23 and terminates in a cam roller structure 72, 73 respectively. The extensions 74, 75 of wedges 43 and 55, respectively, are attached to a cam support plate 76, 77 respectively, each of which carries two pairs of radially positioned cam rollers 78. Cam rollers 78 are adapted for rolling contact on a cam roller track 79, which is formed in the outer face of a release plate 80. Release plate 80 is spaced axially from inner end 71 of drum 23 and is axially movable along four axially positioned guide rods 81, which are supported in the housing of gearbox **21*a*. Positioned on the face of release plate 80 opposite the face on which cam roller track 79 is carried are wedge members 82, one of which is carried on each of the four corners of release plate 80, as more clearly shown in FIG. 10. The wedges are in cooperative engagement with corresponding wedges 83 carried on a wedge mounting plate 84, which is positioned between release plate 80 and gearbox 21*a*. As shown more clearly in FIG. 13, wedge members 82 carried by release plate 80 and wedge members 83 carried by wedge mounting plate 84 are interconnected by means of a dovetail slot arrangement. Wedge mounting plate 84 is positioned for vertical movement between bearbox 21***a* and retaining blocks 85 positioned along two of the opposed outer surfaces thereof. Connected to the lower portion of wedge mounting plate 84 is a rod 86 connected to a piston (not shown) which is carried in a hydraulic cylinder 87, which is secured to the base 88 of gearbox 21*a*. In the position of the parts as shown in FIG. 11, which corresponds with the relative position shown in FIGS. 9 and 10, wedge mounting plate 84 is in its uppermost position, and release plate 80 is at the inner extent of its travel closest to gearbox 21*a*. In FIG. 12 wedge mounting plate 84 is in its lowermost position and wedges 83 have caused release plate 80 to move toward inner end 71 of drum 23, to move wedge ends 74 and 75 inwardly with respect to the drum.

In operation, drum 23 is initially in the condition shown on the left-hand side of FIG. 3 wherein gripper slot 25 is open and drum 23 is in its collapsed position with drum expansion wedge 45 in its innermost position, thereby providing drum 23 with its minimum circumference. At that point in time gripper wedge 43 and drum wedge actuator 55 are in their right-most positions as shown in FIG. 2, the position being generally shown by dashed lines representing the toggle retaining nut position most distant from inner end 71 of drum 23. Leading edge 26 of a strip 19 of material to be rewound is caused to be inserted into gripper slot 25 and at that point piston cylinder arrangement 69 (see FIG. 1) is actuated, causing rod 29 to move to the left as shown in FIG. 2, thereby carrying with it toggle 63, gripper wedge 43, and drum wedge actuator 55, causing gripper bar 37 to move into engagement with and to securely hold leading edge 26 of strip 19 against back-up member 34. Simultaneously, drum actuator 55 has moved to its left-most position, thereby causing drum expansion wedge 45 to move radially outwardly to the position shown on the right-hand side of FIG. 3. Thus at this point leading edge 26 of strip 19 is securely held in slot 25 and drum 23 is at its maximum circumference position.

Drum 23 is then rotated to cause strip 19 to be wound around outer drum surface 24. If more than one strip 19 is being wound, then all of the strips are simultaneously caused to be wound around outer drum surface 24. Because of the variation of thickness across the sheet of material, the centermost strips of material are thicker and wind into a larger diameter coil more quickly, thus causing sagging of the outer strips. When that occurs, gripper wedge 43, drum wedge actuator 55 are once again moved toward their right-most position as shown in FIG. 2, that operation being accomplished by the downward movement of wedge mounting plate 84, which causes release plate 80 to move axially inwardly toward drum 23. Since cam rollers 78 associated with cam support plates 76 and 77 attached to gripper wedge 43 and drum wedge actuator 55 are in contact with cam roller track 79 of release plate 80, gripper wedge 43 and drum wedge actuator 55 are caused to move inwardly, thereby releasing the grip on the leading edges of the strips and simultaneously causing drum segments 31, 32 to move inwardly toward the drum axis, thereby reducing the drum circumference. At that point the centermost strips, since they are under the greatest tension, pull on the center-most coils in such a way that the leading edges thereof are pulled from the slot and the coils themselves caused to rotate in relation to the outer surface of drum 23 to thereby decrease the absolute rotational speed of the innermost coils and thereby reduce the amount of material being taken up on those coils. At the same time, since the outermost strips are under less tension, the forces tending to cause relative rotation between the coils and the drum is less, and therefore those coils will continue to be wound at the same speed until the slack is eliminated and those coils are once again under tension. At that point in the operation, wedge mounting plate 84 is moved upwardly to release the inward pressure on release plate 80, and consequently on cam roller track 79 and cam rollers 78. Piston-Cylinder arrangement 69 is actuated to cause toggle 63 to move from its outermost position shown in dotted lines in FIG. 2 to its innermost position, thereby re-expanding drum 23 so that it is again in closely-fitting relationship with the inner strands of each of the coils in order to continue the recoiling operation. As the operation continues, should further slackening of the outermost coils occur, the same procedure can be repeated, while the drum is rotating, to provide complete control over the tension in the winding coils and to do so in such a way that looping pits and inserts of coil enlarging materials are unnecessary.

While particular embodiments of the invention have been illustrated and described, it will be apparent to those skilled in the art that various changes and modifications can be made without departing from the spirit and scope of the invention, and it is intended to cover in the appended claims all such changes and modifications that fall within the scope of the present invention.

What is claimed is:

1. In a strip recoiling drum including sidewalls movable between radially inner and outer positions whereby the circumference of the drum may be varied and further including a longitudinal gripping slot having a movable gripper capable of engaging an end of a strip placed in the slot; the improvement comprising engaging means including first extensible and retractable means capable, while said drum is rotating, of causing said sidewalls to move towards said radial outer position to expand said drum, and also being capable of simultaneously causing said gripper to engage the end of a strip of material; and releasing means including second extensible and retractable means spaced away from said first extensible and retractable means and capable, while said drum is rotating, of causing said sidewalls to move towards said radial inner position to contract said drum, and also being capable of simultaneously causing said gripper to release the end of a strip of material.

2. In a strip recoiling drum including first and second spaced apart longitudinal wedge means, sidewalls movable between radial inner and outer positions in response to longitudinal movement of said first longitudinal wedge means whereby the circumference of the drum may be varied, and further including a longitudinal gripping slot having a movable gripper capable of movement between engaging and releasing positions in response to movement of the second longitudinal wedge means whereby an end of a strip placed in the slot may be engaged or released; the improvement comprising engaging means including first extensible and retractable means capable, while said drum is rotating, of causing said first wedge means to move in a first longitudinal direction to cause said sidewalls to move towards said radial outer position to expand said drum and also being capable of simultaneously causing said second wedge means to move in said first direction to cause said gripper means to engage an end of a strip of material; and releasing means including second extensible and retractable means spaced away from said first extensible and retractable means and capable, while said drum is rotating, of causing said first longitudinally extending wedge means to move in a second direction to cause said sidewalls to move towards said radial inner position to contract said drum, and also being capable of simultaneously moving said second longitudinal wedge means in said second direction to cause said gripper means to release said end of a strip of material.

3. A strip recoiling drum as set forth in claim 2 wherein said engaging means includes a pull rod connected at one end to the first extensible and retractable means and at the other end to each of said wedge means by a toggle arrangement.

4. A strip recoiling drum as set forth in claim 2 or 3 wherein the releasing means including wedge means external of the drum, said wedge means being connected to said second extensible and retractable means for movement in a direction transverse to the axis of the drum.

5. In a strip recoiling drum including sidewalls movable between radial inner and outer positions whereby the circumference of the drum may be varied, a longitudinal gripping slot having a movable gripper capable of engaging or releasing an end of a strip placed in the slot, and also including a drum wedge for causing the movable sidewalls to be moved and a gripper wedge capable of operating the movable gripper, the improvement comprising:

engaging means operable while said drum is rotating for simultaneously causing the sidewalls to be moved towards the radial outer position and also to simultaneously cause said gripper to engage the end of a strip of material; and releasing means operable while said drum is rotating for simultaneously causing the sidewalls to move towards a radial inner position and to cause said gripper to disengage the end of said strip of material, said releasing means including wedge means external to the drum for causing said drum wedge and said gripper wedge to move in one direction only.

6. The drum of claim 5 wherein the gripper wedge includes a roller at its outer end, a transverse plate movable axially and in contact with said roller and means for moving said plate axially.

7. The drum of claim 5 wherein said drum wedge includes a roller at its outer end, a transverse plate movable axially and in contact with said roller, and means for moving the axial position of said plate.

8. The drum of claims 6 or 7 wherein said plate moving means includes wedges carried by said plate, cooperating wedges on a plate spaced therefrom, and means for moving said plates with respect to each other with the wedges in contact to move said transverse plate axially.

* * * * *